United States Patent [19]

Björkengren et al.

[11] Patent Number: 4,848,594

[45] Date of Patent: Jul. 18, 1989

[54] METHOD AND A DEVICE FOR CONTAMINATION FREE ACCESS TO THE CONTENTS OF A PACKAGING CONTAINER

[75] Inventors: Carl-Axel Björkengren, Åkarp; Magnus Bergström, Bjärred; Per-Stefan Gersbro, Lund, all of Sweden

[73] Assignee: AB Akerlund & Rausing, Sweden

[21] Appl. No.: 152,140

[22] Filed: Feb. 4, 1988

[30] Foreign Application Priority Data

Feb. 17, 1987 [SE] Sweden ..... 8700640

[51] Int. Cl.[4] ..... B65D 47/00

[52] U.S. Cl. ..... 222/1; 222/476; 222/504

[58] Field of Search ..... 222/476, 504, 1; 137/628, 613, 630.16

[56] References Cited

U.S. PATENT DOCUMENTS

| | | | |
|---|---|---|---|
| 1,684,651 | 9/1928 | Wayman et al. | 137/613 |
| 3,173,579 | 3/1965 | Curie et al. | 222/105 |
| 3,842,861 | 10/1974 | Jandrasi et al. | 137/628 |
| 4,598,845 | 7/1986 | Ozdemir | 222/504 X |
| 4,742,851 | 5/1988 | Lundblade | 137/628 X |

FOREIGN PATENT DOCUMENTS

| | | | |
|---|---|---|---|
| 2754534 | 6/1978 | Fed. Rep. of Germany | 222/504 |

*Primary Examiner*—Michael S. Huppert

*Attorney, Agent, or Firm*—Lerner, David, Littenberg, Krumholz & Mentlik

[57] ABSTRACT

A device for contamination free and micro-organism penetration preventing, repeated access to a packaging container containing a pourable filling goods, for instance a sterile fluid or powder. A discharge portion forms a sluice space and is connectable into communication with a packaging container of a flexible material or a so called squeezable type container. At each end of the sluice chamber there are arranged closeable and openable valves or discharge openings. Between said valves or discharge openings there is said sluice chamber, which is of such a length that turbulence phenomena at the external valve do not propagate to the interior of the sluice.

8 Claims, 2 Drawing Sheets

FIG. 4
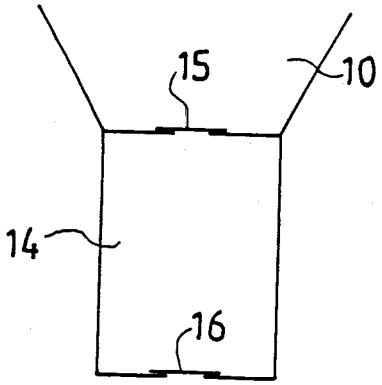
FIG. 5
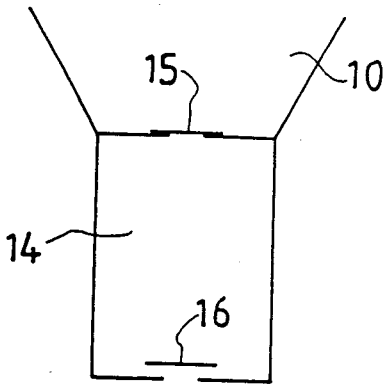
FIG. 6
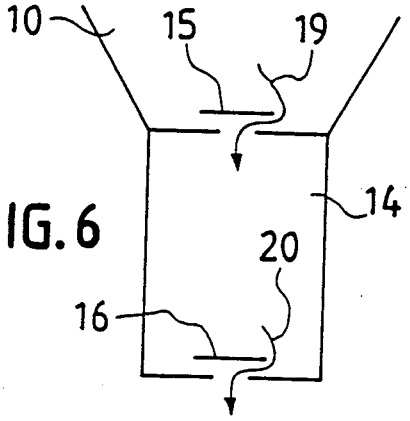
FIG. 7
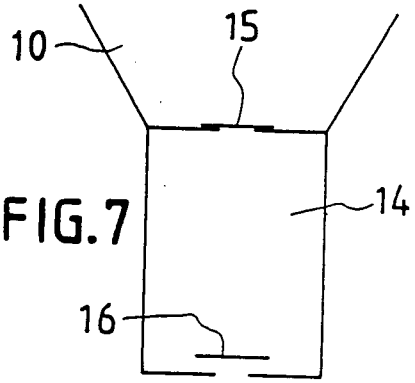
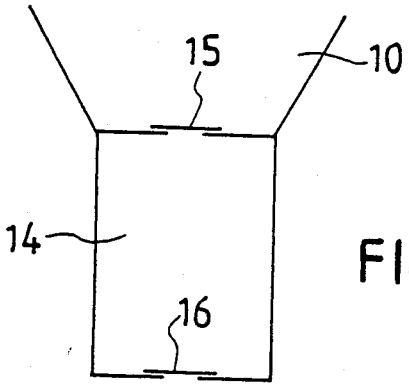
FIG. 8

METHOD AND A DEVICE FOR CONTAMINATION FREE ACCESS TO THE CONTENTS OF A PACKAGING CONTAINER

FIELD OF THE INVENTION

The present invention relates to a device and a method for allowing repeated, contamination free access to the filling goods of a packaging container. More precisely, the invention relates to an application for "king size packages", for instance large pouches or sacks of a flexible material. Other types of packing containers where there is a need for repeated contamination free access to the contents are included within the inventive idea. Thus, the actual technique could be applied to for instance tubes for therapeutic or other compounds, which do not withstand repeated exposure to the environment.

BACKGROUND OF THE INVENTION

In packaging containers, especially king size packages, frequently there is a problem of repeatedly discharging the filling goods in portions or steps without exposing the goods to the environment and the aggressive components possibly contained therein, for instance micro organisms, oxygen, water vapour etc. Especially when the filling goods are of a sterile or aseptic character and if such a character is to be maintained as long as the package contains goods, during repeated partial or portionwise discharging, there is a substantial problem which previously has been impossible to solve, at least in terms of finding a solution which would include a technique useful at the consumer level.

OBJECTS OF THE INVENTION

The object of the present invention is to offer a technique, useful also for instance at the consumer level or in commercial kitchen applications, for allowing a contamination free portionwise or partial discharge of filling goods from a packaging container. The packaging container is of a type that contains filling goods in an amount exceeding the volume necessary at each discrete discharge step, the packaging container may for instance be a king size pouch of a flexible material, for instance plastics film, a laminate or plastics or a laminate of plastics and metal or for instance a container of the squeezeable tube type.

SUMMARY OF THE INVENTION

The invention provides a method for allowig repeatedly contamination free and micro organism penetration preventing access to the pourable filling goods of a packaging container, for instance a liquid or a powder, where the container is selected as a container which has the characteristics of contour close adaption to the filling goods volume during the filling and discharge operation, respectively, or as a container of the squeezeable tube type, and the container is provided with a discharge portion forming a sluice space, and additionally at least a pair of closeable and openable discharge openings are arranged in the discharge portion at a mutual distance in the discharge direction, and access to the container is obtained by arranging the openings such that initially the proximal opening is closed and the distal one first opened.

The method is characterized in that thereafter also the proximal opening is opened, resulting in discharge from the sluice space and the container, whereafter, for terminating a filling goods discharge procedure, the openings are maneuvered to the closed position in the reverse order, and in that said distance between the openings is given such a length that turbulence at the distal end relative the container cannot spread any micro organisms or other contaminating foreign components at such end up to the opening proximal to the container, whereby repeated contamination free and micro organism penetration preventing access to the filling good is obtained.

Preferably the elements determining the flow condition of the openings are maneuvering from the outside of the sluice space, without any need for bushings. The elements may for instance be magnetically controlled valves.

In a preferred embodiment a pair of permanent magnets are used. The pair of magnets comprise a mechanical interconnection means such that the mutual magnet distance determines the time period between the maneuvering times of the openings when the pair of magnets are displaced outside along the discharge portion, towards or away from the container.

The invention also provides a device for carrying out a method for contamination free and micro organism penetration preventing access to a packaging container comprising pourable filling goods.

The device comprises a sluice space arranged for communication with the packaging container, which is of the flexible type or corresponding, and forms a discharge portion, a pair of closeable and openable discharge openings arranged in the discharge portion at a mutual distance in the discharge direction, and means for opening and closing the openings, said means for opening and closing the valves being such that the proximal opening is maintained closed and the distal opening open during a first phase of the access procedure.

The device is characterized in that thereafter the proximal opening is opened by said opening and closing means, resulting in a discharge from the container and the sluice space, whereafter, for terminating the filling goods discharge procedure, the openings are maneuvered to a closed position in a reverse order by said means, and that said distance between the openings is of such a length that turbulence at the opening distal to the container cannot spread any micro organisms or other contaminating elements at such distal end up to the proximal opening, whereby repeated contamination free and micro organism penetration preventing access to the filling goods is obtained. Preferably, magnetically maneuverable elements are arranged for closing and opening the said openings.

In one embodiment the sluice space is encompassed by a magnet which is displaceable at least between said discharge openings, and magnetically maneuverable valve bodies open and close the discharge openings as determined by the movement of the magnet.

In a preferred embodiment a pair of magnets are arranged and mechanically so interconnected that they positively, by the mutual distance therebetween, define the maneuvering times of the openings.

BRIEF DESCRIPTION OF THE DRAWINGS

FIG. 4 shows a discharge portion according to the invention during a non-operative phase, FIG. 5 shows a first phase during discharge, FIG. 6 shows the discharge phase with both openings open, FIG. 7 shows a first phase when terminating a certain discharge procedure, FIG. 8 shows the return to a non-operative phase according to FIG. 4.

DESCRIPTION OF A PREFERRED EMBODIMENT

Figure 1:
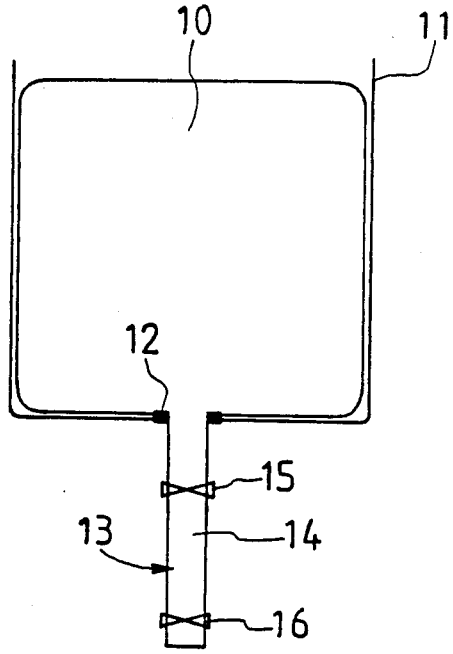
FIG. 1 is a schematic view of a king size pouch provided with a discharge device according to the present invention, FIG. 2 schematically shows a squeeze tube having a discharge auxiliary unit according to the present invention.

The reference numeral 10 in FIG. 1 denotes a king size package of the flexible type, for instance a laminate sack or pouch for pasteurized or sterilized liquid, for instance fruit juice. Such a king size package may contain a volume of tens or even hundreds of litres and is supported in a support device 11, for instance in a commercial kitchen or at the home of an individual consumer.

The packaging container 10 has a connection piece 12, which allows a sterile application of a discharge portion 13 according to the present invention. The connection piece 12 is of a type known per se and there is no need for further details in the present context. The discharge portion according to the present invention and the version shown in FIG. 1 comprises simply a hose 14 of the rigid type, for instance plastics, arranged between two valves 15 and 16. Such valves are of the on/off type and may be maneuvered in different ways.

Figure 3:
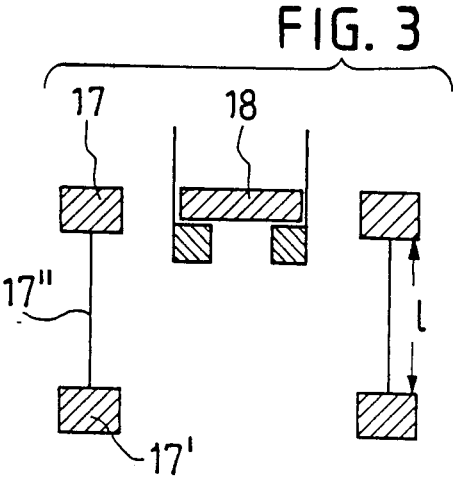
FIG. 3 shows the basic principle for a valve maneuverable magnetially from the outside of the discharge portion.

One example has been shown in FIG. 3, where the ring shaped element 17 denotes a permanent magnet and the plate 18 forming the valve body also is a permanent magnet. Because the magnet 17 may be moved freely externally around the portion 13, the magnetic field thereof will alternately lift and return, respectively, the valve body 18 depending on the position of the magnet 17.

One type of magnet includes a double magnet 17 and 17' comprising two mechanically interconnected magnets. The distance L positively defines the maneuvering times of the openings as the double magnet is moved along the portion 14, up towards or away from the container 10. Instead of a permanent magnet 17 there may of course also be used a magnetic coil, but in household applications the less expensive alternative with a permanent magnet seems preferable.

Figure 2:
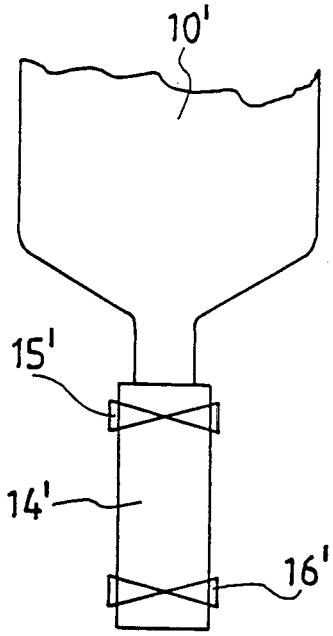

In another version the discharge portion 13 according to the invention may be arranged as a sluice space forming a discharge portion for a squeeze tube 10. In FIG. 2 the discharge portion 13 is directly attached to the neck of the tube and, similar to FIG. 1, it basically comprises a first on/off valve 15 and a second on/off valve 16 placed at each end of a hose 14 forming a sluice chamber.

The FIG. sequence 4–8 basically shows the actual state of the discharge portion and the sluice space, respectively, and the actual state of the valves thereof during a discharge sequence for portioning out a certain volume of the filling goods. The same reference numerals as in FIG. 1 have been used in FIG. 4–8. The valve located closest to the packaging container, the proximal valve, i.e. valve 15 is closed as is the distal valve 16. In case the discharge portion 13 has just been attached to the flexible container 10 the sluice space inside the hose 14 will of course be empty.

In FIG. 5 the distal valve 16 has been opened and shortly thereafter the valve 15 (FIG. 6) is opened, for instance by moving the magnet arrangement in FIG. 3 in a direction towards the container 10. The product now flows out from the container 10 in the direction of the arrows 19 and 20. The container 10, which is of the flexible type automatically compensates to a volume close filling goods skin or otherwise such an adaption is made by hand (in the tube case).

In FIG. 7 the flow 19 is interrupted by closing the valve 15, for instance by now moving the magnet arrangement 17 in FIG. 3 in a direction away from the container, along the outside of the discharge portion or hose 14. As the hose 14 is form stable, the filling goods volume therein (sterile filling goods) basically will remain in the sluice formed by the hose. Thus, the filling goods in the hose 14 is in a stationary condition. When the valve 16 thereafter is closed, by moving the magnet further away from the container, the valve 16 is closed basically turbulence free or with a minimum of "stirring" of the sterile filling goods in the sluice. However, in order to avoid a risk for transferring bacteria and other micro-organisms, the distance between the openings is sufficiently safe for preventing transfer, normally a distance of some 10 mm, preferably at least 50 mm is selected.

Additionally, the distance is sufficient for preventing any growth of bacteria up to the proximal opening associated with valve 15. When a new discharge procedure starts, and the sluice chamber is filled, the filling goods from the container will efficiently wash away any contamination, micro-organisms, etc from the chamber without any risk of them spreading into the interior of the container.

Turbulence and therefore accommodation of any bacteria will be restricted to the distal opening and any residues of bacteria will never reach the proximal opening; there are simply no transport means for the bacteria which as such are immobile. As the operation sequence according to FIG. 5–8 is repeated, the filling goods of the packaging container 10 will not be contaminated or otherwise attacked, for instance by micro-organism penetration, from the outside of the container, i.e. the aseptic condition or the sterile environment may be maintained in the container 10 regardless of repeated portionwise discharges of the contents.

In order to further improve the barrier function more than two valves may be used in the discharge portion. Although a few examples of applications have been indicated, it is realized that the inventive idea is more general and that the invention is restricted merely by the contents of the accompanying claims.

We claim:

1. A device for repeatedly discharging the contents of a container in a manner which prevents contamination of said contents of said container comprising, a. a discharge portion in operative association with a discharge opening in said container, said discharge portion including, i. first valve means proximate to said container, and ii. second valve means distal to said container, b. means for opening and closing said first and said second valve means sequentially such that said second valve means opens prior to said first valve means, and said first valve means then closes prior to said second valve means, and c. said first valve means and said second valve means being separated by a sufficient distance such that any turbulence created at said second valve means during the closing thereof cannot spread any contamination to said first valve means.

2. The device of claim 1 wherein said distance by which said first valve means and said second valve means are separated comprises at least about 10 mm.

3. The device of claim 1 wherein said distance by which said first valve means and said second valve means are separated comprises at least about 50 mm.

4. The device of claim 1 wherein said means for opening and closing said first valve means and said second valve means comprises magnetic means.

5. The device of claim 4 wherein said magnetic means comprises magnetically adjustable valve bodies within said discharge portion, and corresponding displaceable magnet means located exterior to said discharge portion.

6. The device of claim 5 wherein said displaceable magnet means comprises a pair of magnets, one of said pair of magnets associated with said first valve means and a second of said pair of magnets associated with said second valve means.

7. A method for repeatedly discharging the contends of a container in a manner which prevents contamination of said contents of said container comprising, a. providing a discharge opening in said container with a discharge portion including, first valve means proximate to said container and second valve means distal to said container, b. initially opening said second valve means, then c. opening said first valve means thereby discharging a portion of said contents of said container from said discharge portion, d. closing said first valve means thereby terminating said discharge of said portion of said contents of said container, then e. closing said second valve means, and f. maintaining said second valve means at a vertical position below said first valve means, and separated by a sufficient distance such that turbulence created at said second valve means during said closing of said second valve means cannot spread any contamination to said first valve means.

8. The method of claim 7 including opening and closing said first valve means and said second valve means by magnetic control means located exterior to said discharge portion.

* * * * *